US005647499A

United States Patent [19]

Piazza

[11] Patent Number: 5,647,499

[45] Date of Patent: Jul. 15, 1997

[54] BEVERAGE CAN ASSEMBLY WITH STRAW RETENTION MEANS

[76] Inventor: John Piazza, 629 W. Carroll, Lanark, Ill. 61046

[21] Appl. No.: 618,169

[22] Filed: Mar. 19, 1996

[51] Int. Cl.[6] ..... B65D 17/34

[52] U.S. Cl. ..... 220/269; 220/705; 220/906

[58] Field of Search ..... 220/269, 212, 220/229, 705, 709, 906

[56] References Cited

U.S. PATENT DOCUMENTS

| | | | |
|---|---|---|---|
| 3,263,855 | 8/1966 | Pugh, Sr. | 220/212 |
| 3,295,715 | 1/1967 | Pugh | 220/212 |
| 4,717,039 | 1/1988 | Ayyoubi | 220/253 |
| 4,948,009 | 8/1990 | Sawatani | 220/229 |
| 5,031,264 | 7/1991 | Muster | 220/906 X |
| 5,285,919 | 2/1994 | Recchia | 220/271 |
| 5,375,729 | 12/1994 | Schubert | 220/271 |
| 5,494,184 | 2/1996 | Noguchi et al. | 220/269 |

*Primary Examiner*—Stephen Cronin

[57] ABSTRACT

A beverage can assembly adapted for use in association with a straw, the apparatus comprises a beverage can having an upper lid, a bend down panel being formed within the upper lid; and a pull tab being pivotally coupled to the upper lid, the pull tab including a straw retainer, in an operative orientation a user lifting the pull tab thereby forcing the bend down panel downward to define an opening in the upper lid, a user then pivoting the pull tab 180 degrees whereby the pull tab covers the opening, a user then positioning a straw through the straw retainer to secure the straw in a fixed orientation.

6 Claims, 2 Drawing Sheets

BEVERAGE CAN ASSEMBLY WITH STRAW RETENTION MEANS

BACKGROUND OF THE INVENTION

1. Field of the Invention

The present invention relates to a beverage can assembly with straw retention means and more particularly pertains to retaining a straw within the can in a fixed orientation.

2. Description of the Prior Art

The use of straw assemblies for beverage containers is known in the prior art. More specifically, straw assemblies for beverage containers heretofore devised and utilized for the purpose of providing straws for beverage containers are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,071,019 to Sizemore discloses a lid-drinking straw assembly.

U.S. Pat. No. 4,709,829 to Johnson et el. discloses a san-i-can (a beverage container incorporating its own straw).

U.S. Pat. No. Des. 296,989 to Juty discloses a combined can end and pull tab closure.

U.S. Pat. No. 5,273,176 to Diaz discloses a reclosable cover for a beverage can.

U.S. Pat. No. 4,109,817 to Payne et al. discloses a straw assembly for a liquid container.

U.S. Pat. No. 3,994,411 to Elfelt et al. discloses container lid with foldback drink opening.

U.S. Pat. No. 5,172,827 to Chang et al. discloses a beverage container.

While these devices fulfill their respective, particular objective and requirements, the aforementioned patents do not describe a beverage can assembly with straw retention means for retaining a straw within the can in a fixed orientation.

In this respect, the beverage can assembly with straw retention means according to the present invention substantially departs from the conventional concepts and designs of the prior art, and in doing so provides an apparatus primarily developed for the purpose of retaining a straw within the can in a fixed orientation.

Therefore, it can be appreciated that there exists a continuing need for new and improved beverage can assembly with straw retention means which can be used for retaining a straw within the can in a fixed orientation. In this regard, the present invention substantially fulfills this need.

SUMMARY OF THE INVENTION

In the view of the foregoing disadvantages inherent in the known types of straw assemblies for beverage containers now present in the prior art, the present invention provides an improved beverage can assembly with straw retention means. As such, the general purpose of the present invention, which will be described subsequently in greater detail, is to provide a new and improved beverage can assembly with straw retention means and method which has all the advantages of the prior art and none of the disadvantages.

To attain this, the present invention essentially comprises a new and improved beverage can assembly with straw retention means comprising, in combination: a beverage can formed in a generally cylindrically configuration with an upper lid, a bottom end and a cylindrical sidewall therebetween, the beverage can having an essentially hollow interior, a bend down panel being formed within the upper lid, a pull tab having a first end and a second end, a pivot pin being positioned through the pull tab adjacent to the first end and pivotally coupled to the approximate center point of the upper lid, the first end of the pull tab being positioned above the bend down panel; a straw formed in an elongated cylindrical configuration with an upper end and a lower end; and a straw retainer formed in a planar generally circular configuration and formed integrally with the pull tab adjacent to the second end, the straw retainer comprising a rigid outer ring and an inner region formed of semirigid material, the inner region including perpendicularly intersecting slits to form four quadrant sections, in an operative orientation a user lifting the second end of the pull tab thereby pivoting the first end downwardly and forcing the bend down panel toward the hollow interior of the beverage can to define an opening in the upper lid, a user then pivoting the pull tab 180 degrees whereby the pull tab covers the opening, a user then positioning the straw through the straw retainer whereby the lower end being positioned within the hollow interior of the can and the upper end extending above the upper lid of the can, the four quadrant sections of the inner region of the straw retainer functioning to secure the straw in a fixed orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage can assembly with straw retention means which has all the advantages of the prior art straw assemblies for beverage containers and none of the disadvantages.

It is another object of the present invention to provide a new and improved beverage can assembly with straw retention means which may be easily and efficiently manufactured and marketed.

It is a further object of the present invention to provide a new and improved beverage can assembly with straw retention means which is of durable and reliable construction.

An even further object of the present invention is to provide a new and improved beverage can assembly with straw retention means which is susceptible of a low cost of manufacture with regard to both materials and labor, and which accordingly is then susceptible of low prices of sale to the consuming public, thereby making such a beverage can assembly with straw retention means economically available to the buying public.

Still yet another object of the present invention is to provide a new and improved beverage can assembly with straw retention means which provides in the apparatuses and methods of the prior art some of the advantages thereof, while simultaneously overcoming some of the disadvantages normally associated therewith.

Even still another object of the present invention is to provide a new and improved beverage can assembly with straw retention means for retaining a straw within the can in a fixed orientation.

Lastly, it is an object of the present invention to provide a new and improved beverage can assembly with straw retention means adapted for use in association with a straw, the apparatus comprising: a beverage can having an upper lid, a bend down panel being formed within the upper lid; and a pull tab being pivotally coupled to the upper lid, the pull tab including a straw retainer, in an operative orientation a user lifting the pull tab thereby forcing the bend down panel downward to define an opening in the upper lid, a user then pivoting the pull tab 180 degrees whereby the pull tab covers the opening, a user then positioning a straw through the straw retainer to secure the straw in a fixed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
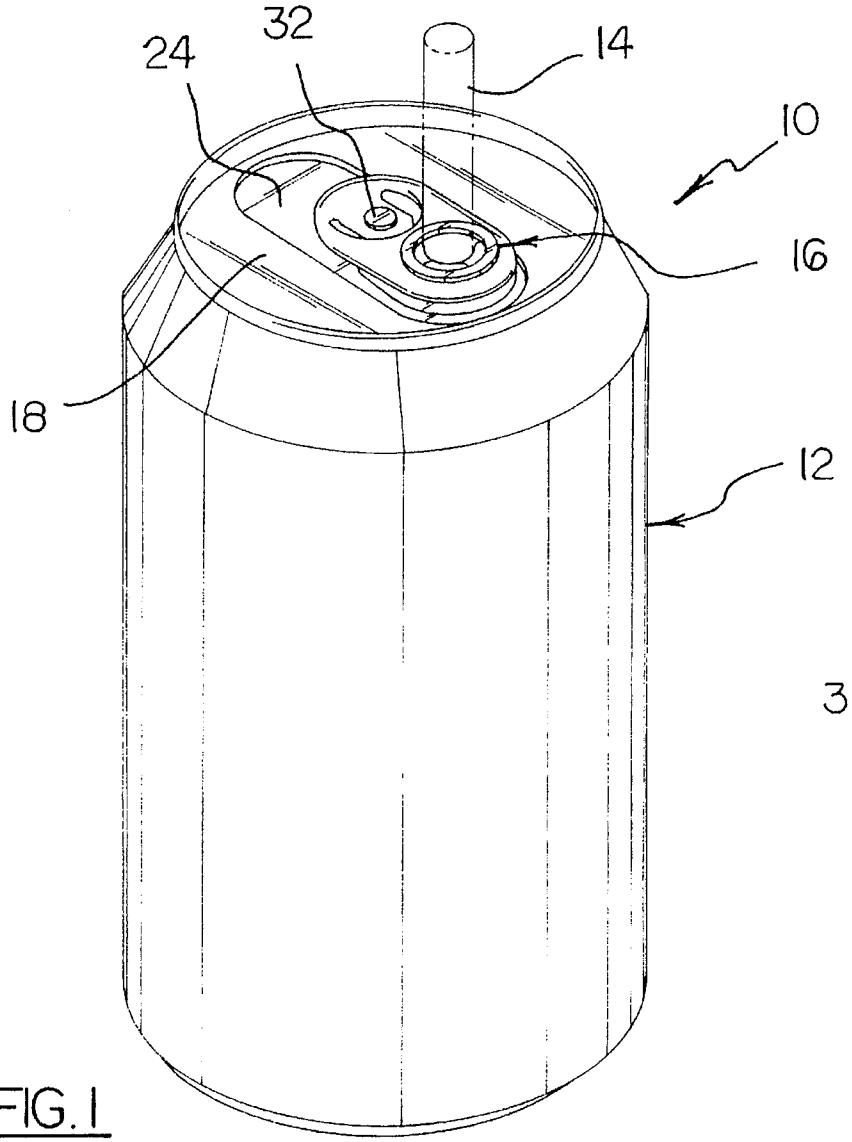
FIG. 1 is a perspective view of the preferred embodiment of the beverage can assembly with straw retention means constructed in accordance with the principles of the present invention.

With reference now to the drawings, and in particular, to FIG. 1 thereof, the preferred embodiment of the new and improved beverage can assembly with straw retention means embodying the principles and concepts of the present invention and generally designated by the reference number 10 will be described.

Specifically, it will be noted in the various Figures that the device relates to a beverage can assembly with straw retention means 10 for retaining a straw within the can in a fixed orientation. In its broadest context, the device consists of a beverage can 12, a straw 14 and a straw retainer 16. Such components are individually configured and correlated with respect to each other so as to attain the desired objective.

Figure 3:
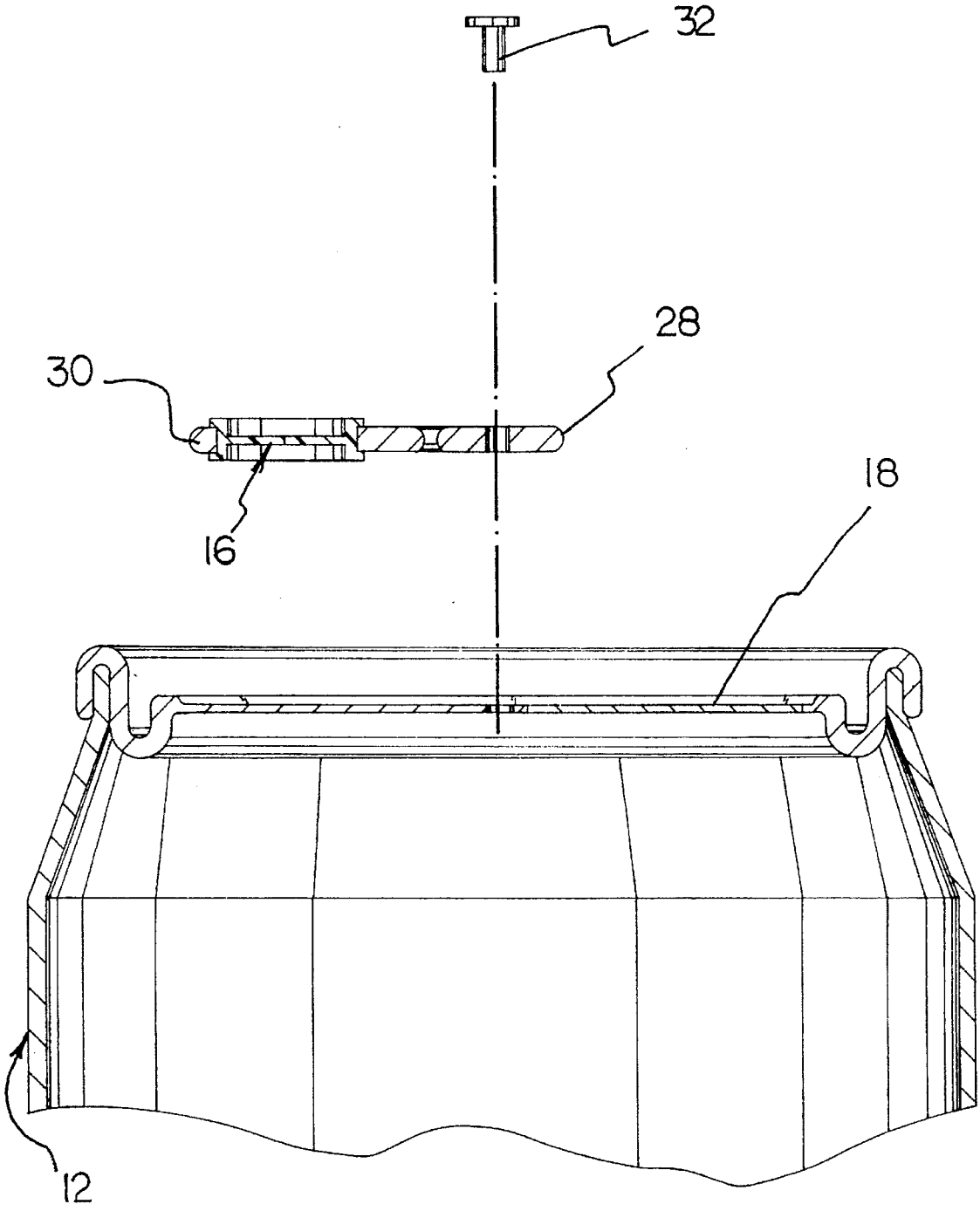
FIG. 3 is a separated cross sectional view taken along section line 3—3 of FIG. 2 illustrating the various components of the apparatus.

The beverage can 12 is formed in a generally cylindrically configuration with an upper lid 18, a bottom end 20 and a cylindrical sidewall 22 therebetween. The beverage can 12 is fabricated of aluminum and has an essentially hollow interior. In alternate embodiments the beverage can is fabricated of one of the following materials: plastic, steel, tin. In an operative orientation, a liquid beverage is contained within the beverage can. Note FIGS. 1 and 3.

Figure 2:
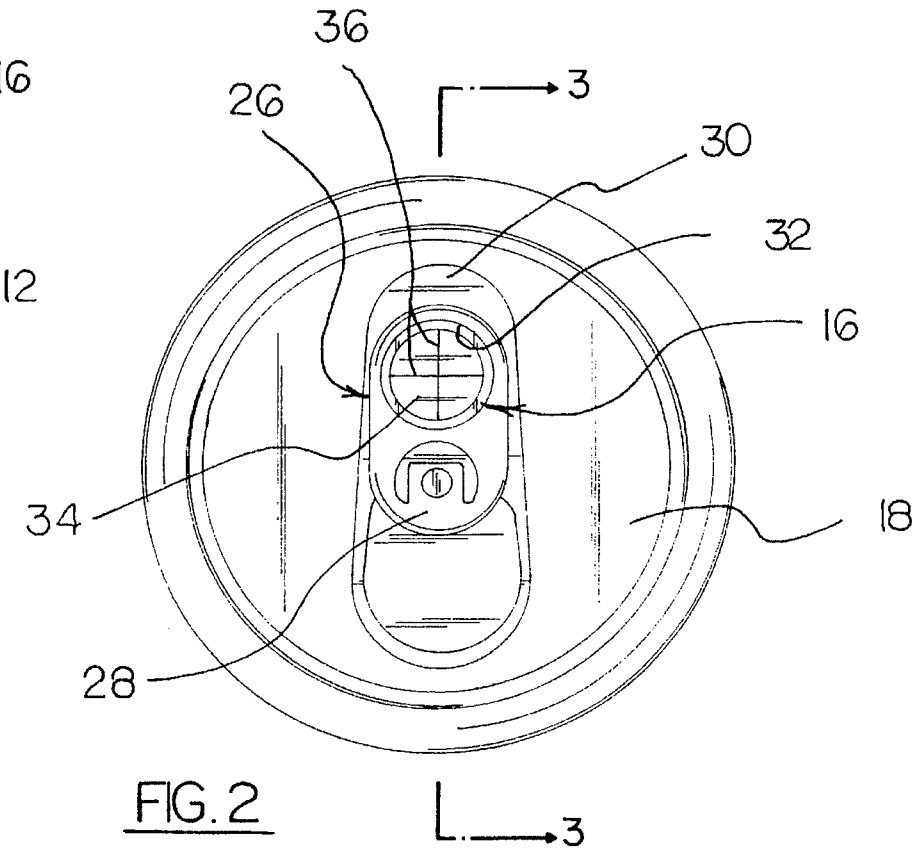
FIG. 2 is a top plan view illustrating the pull tab of the apparatus.

A bend down panel 24 is formed within the upper lid. A small portion of the bend down panel is permanently affixed to the upper lid. The majority of the bend down panel is releasably coupled to the periphery of an opening in the lid. When sufficient downward pressure is applied to the bend down panel, the panel bends within the interior of the beverage can to expose the opening. The permanently affixed portion of the panel 24 prevents it from falling into the can. Note FIGS. 1 and 2.

A pull tab 26 is fabricated of aluminum and has a first end 28 and a second end 30. A pivot pin 32 is positioned through the pull tab adjacent to the first end. The pivot pin 32 is pivotally coupled to the approximate center point of the upper lid. The pivot pin has a shaft to permit horizontal pivoting of the pull tab. The pivot pin has a head to permit pivoting of the pull tab in a generally vertical direction. The first end 28 of the pull tab is positioned above the bend down panel 24. Note FIGS. 1, 2 and 3.

The straw 14 is fabricated of semirigid plastic and formed in an elongated cylindrical configuration with an upper end and a lower end. As with all conventional straws the interior is hollow to permit a user to draw beverage through the straw when the lower end is positioned within a subject beverage. Note FIG. 1.

The straw retainer 16 is formed in a planar generally circular configuration and formed integrally with the pull tab 26 adjacent to the second end 30. The straw retainer 16 comprises a rigid outer ring 32 and an inner region 34 formed of semirigid material, preferably plastic. In alternative embodiments the inner region of the straw retainer is fabricated of one of the following materials: metal foil, rubber, cardboard. The inner region includes perpendicularly intersecting slits 36 which form four quadrant sections. Note FIGS. 1 and 2.

In an operative orientation a user lifts the second end of the pull tab thereby pivoting the first end downwardly. This action forces the bend down panel toward the hollow interior of the beverage can to define an opening in the upper lid. A user then pivots the pull tab 180 degrees whereby the pull tab covers the opening. This configuration helps prevent spillage of beverage from the can and prevents insects from entering the interior of the can. A user then positions the straw 14 through the straw retainer 16 whereby the lower end is positioned within the hollow interior of the can. The upper end of the straw extends above the upper lid of the can for access by a user. The four quadrant sections of the inner region of the straw retainer 16 function to secure the straw in a fixed orientation. The four quadrants exert radial forces upon the straw to retain the straw in a vertical or angled orientation. Note FIGS. 1 and 2.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved beverage can assembly with straw retention means comprising, in combination:

a beverage can formed in a generally cylindrically configuration with an upper lid, a bottom end and a cylindrical sidewall therebetween, the beverage can having an essentially hollow interior, a bend down panel being formed within the upper lid, a pull tab having a first end and a second end, a pivot pin being positioned through the pull tab adjacent to the first end and pivotally coupled to the approximate center point of the upper lid, the first end of the pull tab being positioned above the bend down panel;

a straw formed in an elongated cylindrical configuration with an upper end and a lower end; and a straw retainer formed in a planar generally circular configuration and formed integrally with the pull tab adjacent to the second end, the straw retainer comprising a rigid outer ring and an inner region formed of semirigid material, the inner region including perpendicularly intersecting slits to form four quadrant sections, in an operative orientation a user lifting the second end of the pull tab thereby pivoting the first end downwardly and forcing the bend down panel toward the hollow interior of the beverage can to define an opening in the upper lid, a user then pivoting the pull tab 180 degrees whereby the pull tab covers the opening, a user then positioning the straw through the straw retainer whereby the lower end being positioned within the hollow interior of the can and the upper end extending above the upper lid of the can, the four quadrant sections of the inner region of the straw retainer functioning to secure the straw in a fixed orientation.

2. A beverage can assembly with straw retention means adapted for use in association with a straw, the apparatus comprising:

a beverage can having an upper lid, a bend down panel being formed within the upper lid; and a pull tab being pivotally coupled to the upper lid, the pull tab including a straw retainer, the pull tab having a first end positioned above the bend down panel and a second end, the straw retainer being formed in a planar generally circular configuration and formed integrally with the pull tab adjacent to the second end, the straw retainer comprising a rigid outer ring and an inner region formed of semirigid material, the inner region including slits, in an operative orientation a user lifting the pull tab thereby forcing the bend down panel downward to define an opening in the upper lid, a user then pivoting the pull tab 180 degrees whereby the pull tab covers the opening, a user then positioning a straw through the straw retainer to secure the straw in a fixed orientation.

3. The beverage can assembly with straw retention means as set forth in claim 2 wherein the beverage can is formed in a generally cylindrically configuration with an a bottom end and a cylindrical sidewall, the beverage can having an essentially hollow interior, and wherein the pull tab has a first end and a second end, a pivot pin being positioned through the pull tab adjacent to the first end to pivotally couple the pull tab to the approximate center point of the upper lid, the first end of the pull tab being positioned above the bend down panel.

4. The beverage can assembly with straw retention means as set forth in claim 2 and further including a straw formed in an elongated generally cylindrical configuration with an upper end and a lower end.

5. The beverage can assembly with straw retention means as set forth in claim 2 wherein the beverage can and pull tab are each fabricated of aluminum.

6. A beverage can assembly with straw retention means adapted for use in association with a straw, the apparatus comprising:

a beverage can having an upper lid, a bend down panel being formed within the upper lid; and a pull tab being pivotally coupled to the upper lid, the pull tab including a straw retainer, the straw retainer being fabricated of plastic in an operative orientation a user lifting the pull tab thereby forcing the bend down panel downward to define an opening in the upper lid, a user then pivoting the pull tab 180 degrees whereby the pull tab covers the opening, a user then positioning a straw through the straw retainer to secure the straw in a fixed orientation.

* * * * *